US006308468B1

(12) United States Patent
Caruso

(10) Patent No.: US 6,308,468 B1
(45) Date of Patent: Oct. 30, 2001

(54) EARTH ANCHOR FOR SUPPORTING A POLE

(76) Inventor: Anthony Caruso, 140 Pacific Dr., Quakertown, PA (US) 18951

( * ) Notice: Subject to any disclaimer, the term of this patent is extended or adjusted under 35 U.S.C. 154(b) by 0 days.

(21) Appl. No.: 09/157,263

(22) Filed: Sep. 21, 1998

(51) Int. Cl.[7] ..... E02D 5/74

(52) U.S. Cl. ..... 52/165; 52/153; 248/530; 248/533; 411/489; 411/480; 411/923

(58) Field of Search ..... 52/153, 165; 248/156, 248/530, 533; 411/489, 488, 480, 923; 472/29; 473/478, 473, 197, 474, 423

(56) References Cited

U.S. PATENT DOCUMENTS

| | | | | |
|---|---|---|---|---|
| 122,947 | * | 1/1872 | Hopgood | 52/153 |
| 401,302 | * | 4/1889 | Purdy | 52/156 |
| 891,448 | * | 6/1908 | Snider | 52/165 |
| 930,607 | * | 8/1909 | Morrill | 52/165 |
| 1,438,074 | * | 12/1922 | Welch | 52/165 |
| 3,225,734 | * | 12/1965 | Bule | 248/156 |
| 3,570,795 | * | 3/1971 | Benzel | 248/156 |
| 4,161,723 | | 7/1979 | De Vittori . | |
| 4,290,245 | * | 9/1981 | Pardue, Jr. et al. | 52/165 |
| 4,407,505 | | 10/1983 | Kendziorski . | |
| 4,601,255 | | 7/1986 | Marcotti . | |
| 4,649,678 | * | 3/1987 | Lamson | 52/165 |
| 4,921,200 | * | 5/1990 | Moraly | 248/545 |
| 4,939,877 | | 7/1990 | Claffey . | |
| 4,955,068 | * | 9/1990 | Tennihan | 52/165 |
| 5,247,900 | * | 9/1993 | Sobczack | 116/209 |
| 5,303,931 | | 4/1994 | Brown . | |
| 5,568,785 | * | 10/1996 | Hazen | 52/153 |
| 5,632,585 | * | 5/1997 | Kluser | 411/480 |
| 5,706,756 | | 1/1998 | Cunningham et al. . | |
| 5,722,205 | * | 3/1998 | Gannaway | 52/153 |
| 5,809,700 | * | 9/1998 | Roush et al. | 52/165 |

* cited by examiner

*Primary Examiner*—Beth A. Stephan
*Assistant Examiner*—Dennis L. Dorsey
(74) *Attorney, Agent, or Firm*—Richard L. Miller

(57) ABSTRACT

An earth anchor for a pole that includes a base, a spike, and attaching apparatus. The base has a lowermost face for contacting the earth, an uppermost face opposite to the lowermost face, and a longitudinal axis. The spike is for insertion into the earth, and depends from the lowermost face of the base. The attaching apparatus is for engaging a pole, and is disposed on the uppermost face of the base. The base is disk-shaped with a circular periphery for providing a blunt round edge that eliminates corners when tipped on which a player could fall and be injured, and is wide for leaving enough room for the pole to still be pushed into the earth using foot pressure. The attaching apparatus includes a stop boss disposed on the uppermost face of the base, along the longitudinal axis of the base, which centers the attaching apparatus for allowing the pole to have identical stability in all directions. The attaching apparatus further includes a peg that extends coaxially upwardly from, and is narrower than, the stop boss. The attaching apparatus further includes a coil spring for snugly receiving, and allowing 360 degrees of freedom for, the pole, and which extends coaxially-upwardly from, and with a portion thereof fitting snugly around, the peg, until the stop boss of the attaching apparatus. The attaching apparatus can include, in place of the stop boss, the peg, and the coils spring, a sleeve.

2 Claims, 2 Drawing Sheets

EARTH ANCHOR FOR SUPPORTING A POLE

BACKGROUND OF THE INVENTION

1. Field of the Invention

The present invention relates to an earth support. More particularly, the present invention relates to an earth support for a pole.

2. Description of the Prior Art

Current flag base designs are square or rectangle. When tipped, they create a corner on which a player could fall onto a be injured. Current flag base designs also tip easily from one side to the other because the peg mounted on the bottom is not centered.

Numerous innovations for flag related devices have been provided in the prior art that will be described. Even though these innovations may be suitable for the specific individual purposes to which they address, however, they differ from the present invention.

A FIRST EXAMPLE, U.S. Pat. No. 4,161,723 to De Vittori teaches a flagpole, particularly for indicating goals in skiing competitions, comprising an upper flag carrying portion and a lower pointed portion connected by a helical spring. When this flagpole is driven into the ground, it can move elastically laterally when hit by a skier, thus avoiding to be knocked down or causing injuries to the skier. Preferably the flagpole is provided with a semi-cylindrical abutment shell on one side so that it can move only to the other side, with a telescoping sleeve in its lower pointed portion for adjusting its length, and anvils adapted to be struck with a hammer for driving it down into the ground or hard snow.

A SECOND EXAMPLE, U.S. Pat. No. 4,407,505 to Kendziorski teaches a portable, collapsible flagstaff suitable for use to support a practice golf flag is disclosed, wherein the flagstaff comprises at least an upper, middle and bottom segment which are detachably connected to one another; a weighted cylindrical base at the foot of the bottom segment; a spike projecting from the bottom of the base for anchoring the flagstaff in the ground; and a cylindrical cavity in the base in which the spike can be stowed when the flagstaff is in the storage configuration. Also disclosed is a storage configuration wherein the middle and upper segments of the flagstaff are mounted on a bottom keeper plate resting upon the top of the base, and all of the segments are secured together at their upper termini by a top keeper plate or by a 3- or 4-tube top keeper element, and the spike is stowed in an inverted position within the cavity in the base. An elongated "D"-shaped flat-mounting bracket is shown whereby a flag can be pivotably mounted upon the upper segment of the erect flagstaff.

A THIRD EXAMPLE, U.S. Pat. No. 4,601,255 to Marcotti teaches a signal flag or pennant for use at sporting events consisting of an elongated flag staff on which is attached a hollow transparent flat envelope such as a plastic envelope into which is inserted a flag or pennant. A semi-circular spring-loaded clip having a diameter slightly smaller than the flag staff frictionally retains the plastic envelope to the staff. The flag or pennant can be removed at will from the plastic envelope and different flags or pennants can be inserted, depending upon the sporting event attended. The plastic envelope prevents rain or moisture from damaging the flag or pennant during its use.

A FOURTH EXAMPLE, U.S. Pat. No. 4,939,877 to Claffey teaches a removable earth anchor for supporting the post of signs, flags, road markers and the like. The anchor is designed to accommodate connection to various types and shapes of support posts.

A FIFTH EXAMPLE, U.S. Pat. No. 5,303,931 to Brown teaches a method of manufacturing a two-section flag pole comprising a pointed lower section for planting into the ground and an upper section having a colored area and a numbered flag for establishing a target in a game of flying-disc golf. Each flag may be removed from or rolled over the pole and the pole can be disassembled for ease of storage. A threaded or snap-on quick-coupler is used to assemble the two sections of each pole, so that it may be easily and quickly installed at each selected target site. The flag poles can be manufactured entirely by utilizing standard-size tubing available for gardening applications.

A SIXTH EXAMPLE, U.S. Pat. No. 5,706,756 to Cunningham et al. teaches a flag for throwing having a flexible main body member, a flexible handle member having a first end attached to the main body member, and a throwing weight attached to the main body member. The throwing weight is attached to the main body member adjacent to the intersection of the handle member and the main body member, and is positioned in a pocket formed at the intersection of said main body member and said handle member.

It is apparent that numerous innovations for flag related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an earth anchor for a pole that avoids the disadvantages of the prior art.

ANOTHER OBJECT of the present invention is to provide an earth anchor for a pole that is simple and inexpensive to manufacture.

STILL ANOTHER OBJECT of the present invention is to provide an earth anchor for a pole that is simple to use.

BRIEFLY STATED, YET ANOTHER OBJECT of the present invention is to provide an earth anchor for a pole that includes a base, a spike, and attaching apparatus. The base has a lowermost face for contacting the earth, an uppermost face opposite to the lowermost face, and a longitudinal axis. The spike is for insertion into the earth, and depends from the lowermost face of the base. The attaching apparatus is for engaging a pole, and is disposed on the uppermost face of the base. The base is disk-shaped with a circular periphery for providing a blunt round edge that eliminates corners when tipped on which a player could fall and be injured, and is wide for leaving enough room for the pole to still be pushed into the earth using foot pressure. The attaching apparatus includes a stop boss disposed on the uppermost face of the base, along the longitudinal axis of the base, which centers the attaching apparatus for allowing the pole to have identical stability in all directions. The attaching apparatus further includes a peg that extends coaxially upwardly from, and is narrower than, the stop boss. The attaching apparatus further includes a coil spring for snugly receiving, and allowing 360 degrees of freedom for, the pole, and which extends coaxially-upwardly from, and with a portion thereof fitting snugly around, the peg, until the stop boss of the attaching apparatus. The attaching apparatus can include, in place of the stop boss, the peg; and the coils spring, a sleeve.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 4:
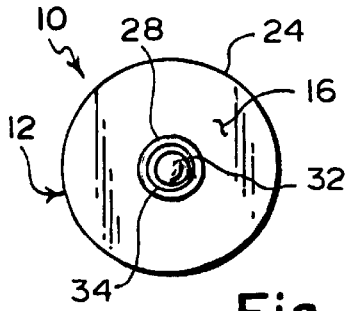
FIG. 4 is an enlarged diagrammatic top plan view taken generally in the direction of arrow 4 in FIG. 1.

First Embodiment 10 earth anchor for a pole of the present invention
12 base
14 lowermost face of base 12 for contacting earth 15
15 earth
16 uppermost face of base 12
18 longitudinal axis of base 12
20 spike for insertion into earth 15
22 attaching apparatus for engaging pole 23
23 pole
24 circular periphery of base 12 for providing blunt round edge eliminating corners when tipped on which player could fall and be injured
26 four longitudinal faces of spike 20
28 stop boss of attaching apparatus 22
32 peg of attaching apparatus 22
34 coil spring of attaching apparatus 22 for snugly receiving, and allowing 360 degrees of freedom for, pole 23

Second Embodiment 110 earth anchor for a pole of the present invention
122 sleeve for receiving pole 123
123 pole
124 threaded bore in sleeve 122
126 threaded fastener for applying pressure to pole 123 to maintain pole 123 in sleeve 122

DETAILED DESCRIPTION OF THE PREFERRED EMBODIMENT

Figure 1:
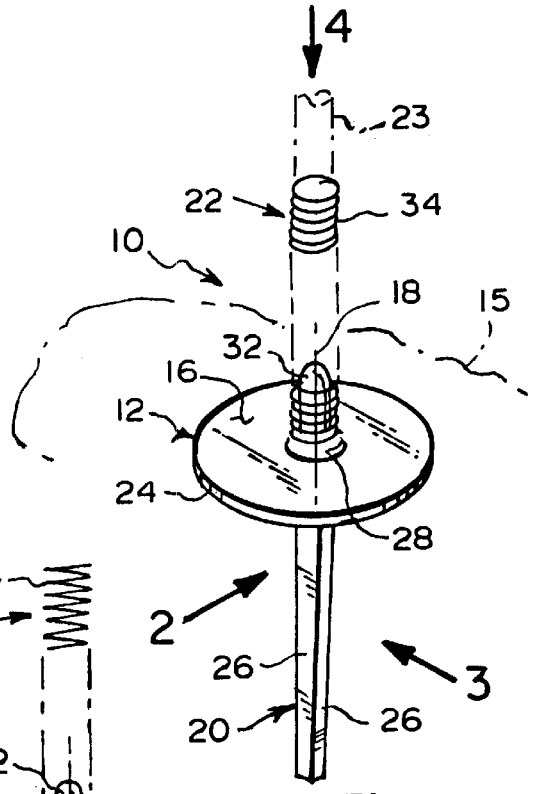
FIG. 1 is a diagrammatic perspective view of a first embodiment of the present invention.
Figure 2:
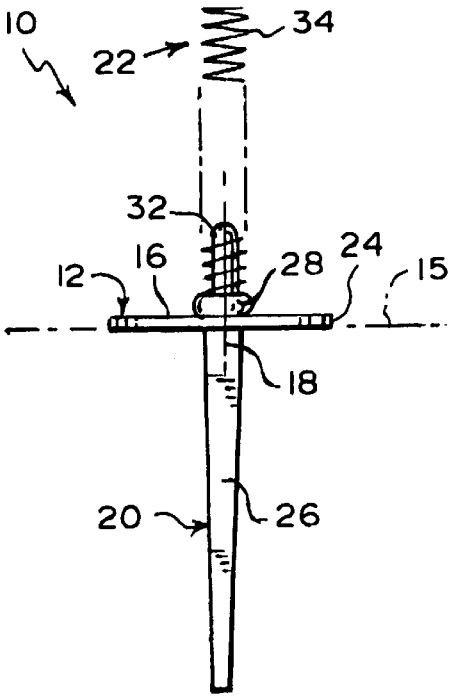
FIG. 2 is an enlarged diagrammatic front elevational view taken generally in the direction of arrow 2 in FIG. 1.
Figure 3:
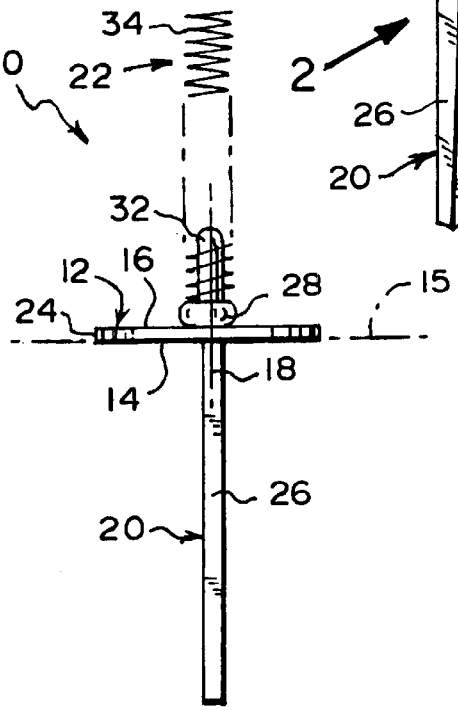
FIG. 3 is an enlarged diagrammatic end elevational view taken generally in the direction of arrow 3 in FIG. 1.

Referring now to the figures, in which like numerals indicate like parts, and particularly to FIGS. 1–4, a first embodiment of the earth anchor for a pole of the present invention is shown generally at 10.

The earth anchor for a pole 10 comprises a base 12 having a lowermost face 14 for contacting the earth 15, an uppermost face 16 opposite to the lowermost face 14 of the base 12, and a longitudinal axis 18.

The earth anchor for a pole 10 further comprises a spike 20 for insertion into the earth 15, and which depends from the lowermost face 14 of the base 12, along the longitudinal axis 18 of the base 12.

The earth anchor for a pole 10 further comprises attaching apparatus 22 for engaging a pole 23, and which is disposed on the uppermost face 16 of the base 12, along the longitudinal axis 18 of the base 12.

The base 12 is disk-shaped with a circular periphery 24 for providing a blunt round edge that eliminates corners when tipped on which a player could fall and be injured, and which is wide for leaving enough room for the pole to still be pushed into the earth 15 using foot pressure.

The spike 20 is elongated and slender, and has four longitudinal faces 26, with two opposing faces thereof being wider than two remaining opposing faces thereof.

The attaching apparatus 22 comprises a stop boss 28 disposed on the uppermost face 16 of the base 12, along the longitudinal axis 18 of the base 12, which centers the attaching apparatus 22 for allowing the pole 23 to have identical stability in all directions.

The attaching apparatus 22 further comprises a peg 32 that extends coaxially upwardly from, and is narrower then, the stop boss 28 of the attaching apparatus 22.

The attaching apparatus 22 further comprises a coil spring 34 for snugly receiving, and allowing 360 degrees of freedom for, the pole 23, and which extends coaxially-upwardly from, and with a portion thereof fitting snugly around, the peg 32 of the attaching apparatus 22, until the stop boss 28 of the attaching apparatus 22.

Figure 8:
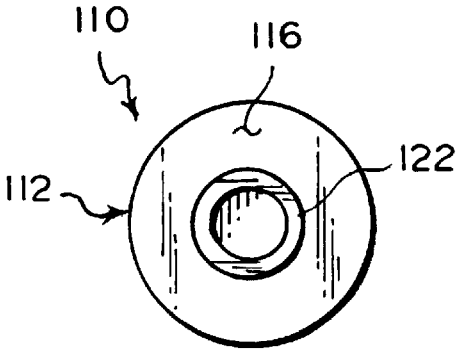
FIG. 8 is an enlarged diagrammatic top plan view taken generally in the direction of arrow 8 in FIG. 5.
Figure 5:
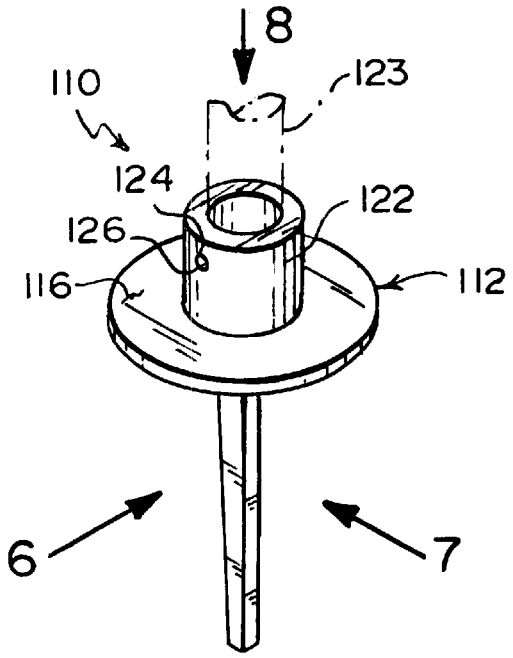
FIG. 5 is a diagrammatic perspective view of a second embodiment of the present invention.
Figure 6:
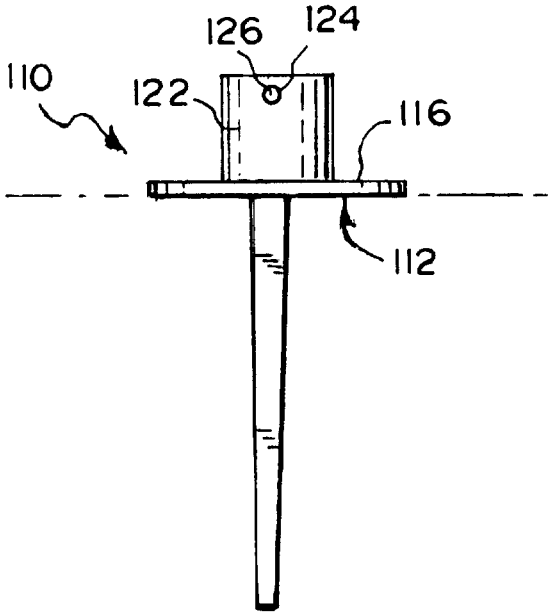
FIG. 6 is an enlarged diagrammatic front elevational view taken generally in the direction of arrow 6 in FIG. 5.
Figure 7:
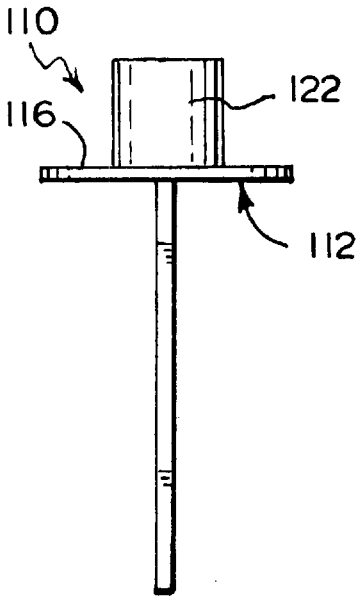
FIG. 7 is an enlarged diagrammatic end elevational view taken generally in the direction of arrow 7 in FIG. 5.

The configuration of a second embodiment of the earth anchor for a pole 110 can best be seen in FIGS. 5–8, and as such will be discussed with reference thereto.

The earth anchor for a pole 110 is similar to the earth anchor for a pole 10, except that the stop boss 28 of the attaching apparatus 22, the peg 32 of the attaching apparatus 22, and the coil spring 34 of the attaching apparatus 22 are replaced by a sleeve 122 for receiving the pole 123, and which extends coaxially upwardly from the uppermost face 116 of the base 112.

The sleeve 122 has a threaded bore 124 that extends laterally therein, and which threadably receives a threaded fastener 126 for applying pressure to the pole 123 to maintain the pole 123 in the sleeve 122.

It will be understood that each of the elements described above, or two or more together, may also find a useful application in other types of constructions differing from the types described above.

While the invention has been illustrated and described as embodied in an earth anchor for a pole, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An earth anchor for supporting a pole, comprising:

a) a base having a lowermost face for contacting the earth, an uppermost face opposite to said lowermost face of said base, and a longitudinal axis; said base being disk-shaped with a circular periphery for providing a blunt round edge eliminating corners when tipped on, which a player could fall and be injured, and being wide for leaving enough room for the pole to still be pushed into the earth using foot pressure;

b) a spike for insertion into the earth, and which depends from said lowermost face of said base, along said longitudinal axis of said base; and c) attaching apparatus for engaging a pole, and which is disposed on said uppermost face of said base, along said longitudinal axis of said base; said attaching apparatus comprising:

i) a stop boss disposed on said uppermost face of said base, along said longitudinal axis of said base, and centering said attaching apparatus for allowing the pole to have identical stability in all directions;

ii) a peg extending coaxially upwardly from, and being narrower than, said stop boss of said attaching apparatus; and iii) a coil spring for snugly receiving, and allowing 360 degrees of freedom for, the pole, and extending coaxially-upwardly from, and having a portion thereof fitting snugly around, said peg of said attaching apparatus, until said stop boss of said attaching apparatus.

2. The anchor as defined in claim 1, wherein said spike is elongated and slender, and has four longitudinal faces, with two opposing faces thereof being wider than two remaining opposing faces thereof.

* * * * *